US009183765B2

(12) United States Patent
Frankenbach et al.

(10) Patent No.: US 9,183,765 B2
(45) Date of Patent: Nov. 10, 2015

(54) CONSUMER PRODUCT ARRAY, RETAIL DISPLAYS AND METHODS OF DOING THE SAME

(75) Inventors: Gayle Marie Frankenbach, Cincinnati, OH (US); Thomas Jackson Kirk, Cincinnati, OH (US); Elise Tomsik Edelman, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1340 days.

(21) Appl. No.: 11/702,307

(22) Filed: Feb. 5, 2007

(65) Prior Publication Data

US 2008/0098630 A1 May 1, 2008

Related U.S. Application Data

(60) Provisional application No. 60/764,970, filed on Feb. 3, 2006.

(51) Int. Cl.
*G09F 3/00* (2006.01)
*G09F 23/00* (2006.01)

(52) U.S. Cl.
CPC . *G09F 3/00* (2013.01); *G09F 23/00* (2013.01)

(58) Field of Classification Search
USPC ..... 40/630, 638
See application file for complete search history.

(56) References Cited

U.S. PATENT DOCUMENTS

| | | | | |
|---|---|---|---|---|
| 1,397,079 | A * | 11/1921 | Cohen | 40/665 |
| 4,763,930 | A * | 8/1988 | Matney | 283/81 |
| 5,535,536 | A * | 7/1996 | Comann | 40/310 |
| 5,758,440 | A * | 6/1998 | Yudin | 40/310 |
| 5,857,275 | A * | 1/1999 | Deal | 40/310 |
| 5,924,739 | A * | 7/1999 | Garbutt | 283/81 |
| 6,327,801 | B1 * | 12/2001 | Witkowski | 40/306 |
| 6,709,017 | B2 * | 3/2004 | Ross | 283/81 |
| 6,786,515 | B2 * | 9/2004 | Franko, Sr. | 283/81 |
| 7,010,877 | B2 * | 3/2006 | Geary | 40/310 |
| 2003/0234199 | A1 * | 12/2003 | Morita et al. | 206/459.5 |
| 2004/0111934 | A1 * | 6/2004 | O'Connell | 40/310 |
| 2006/0187141 | A1 * | 8/2006 | Weis et al. | 345/1.1 |
| 2006/0271427 | A1 * | 11/2006 | Raimondo | 705/14 |

FOREIGN PATENT DOCUMENTS

| | | | |
|---|---|---|---|
| WO | WO 2006/130284 | A1 | 12/2006 |
| WO | WO 2006/135883 | A1 | 12/2006 |

OTHER PUBLICATIONS

Snuggle, Snuggle.com, Feb. 27, 2004, http://web.archive.org/web/20040227161511/www.snuggle.com/product/product_line.asp.*
Snuggle, Snuggle, Oct. 5, 2003.*

* cited by examiner

*Primary Examiner* — Shin Kim
(74) *Attorney, Agent, or Firm* — Melissa Krasovec

(57) ABSTRACT

The present invention relates to arrays of consumer products, retail displays of arrays of consumer products and methods for displaying an array of consumer products.

18 Claims, 6 Drawing Sheets

CONSUMER PRODUCT ARRAY, RETAIL DISPLAYS AND METHODS OF DOING THE SAME

CROSS REFERENCE TO RELATED APPLICATION

This application claims the benefit of U.S. Provisional Application Ser. No. 60/764,970, filed Feb. 3, 2006.

FIELD OF THE INVENTION

The present invention relates to arrays of consumer products, retail displays of arrays of consumer products and methods for displaying an array of consumer products.

BACKGROUND OF THE INVENTION

Consumers have learned to trust certain products from certain sources for specific use. They have also learned to associate or identify certain events, features and/or elements with not only the product but also its properties or features, i.e. the aroma or scent of PINESOL brand hard surface cleaner is associated with sanitary cleaning, a television commercial portraying a woman soaking her hands in dish detergent recalls an association that COLGATE PALMOLIVE brand dish detergent is soft on your hands while you "do the dishes," consumers associate the CLOROX brand logo with bleach and whiter than white clothing.

While such associations may help to build powerful brand identity, such associations may have some commercial disadvantages for the owners of the goods. One such disadvantage is seen when the owner of the goods wants to extend the commercial line up of available products having such a powerful consumer association. While the consumers have the positive association for the existing product they may have no such positive associations with the new product, or line extension, especially when it provides a different consumer benefit. An example of this would be COLGATE PALMOLIVE brand dish detergent. As noted previously consumers already have formed a perception about not only the quality of the COLGATE PALMOLIVE product itself but also what properties it is most readily associated with, such as mildness on hands while washing. However, no such positive perception or consumer association with desirable attributes or properties would necessarily be present if the owners of the COLGATE PALMOLIVE brand dish detergent were to release a line of kitchen implements, such as sponges under the COLGATE PALMOLIVE brand. It would take time and money to produce in consumers a positive perception or consumer association with desirable attributes or properties. Contrast this with SCOTCH-BRITE brand sponges, a brand of sponges that already has positive perception or consumer association with desirable attributes or properties. However, if the makers of SCOTCH-BRITE brand sponges were to release a line extension of dish detergent, then they could face the same problem that the makers of COLGATE PALMOLIVE brand dish detergent would have in releasing a line extension of line of kitchen implements. Other similar adjacencies and/or related products that are highly desirable could be for example, the makers of FORMULA 409 brand hard surface cleaner releasing a line of paper towels, the makers of SPARKLE brand paper towels releasing a line of hard surface cleaners, the makers of SURF brand laundry detergent releasing a line of fabric treatment products, such as fabric softener, dryer sheets, pretreated, dye magnets, etc.

The problem is that while each of these different products has positive perception or consumer association with desirable attributes or properties in a category it is at present more difficult to use these in another adjacent category.

SUMMARY OF THE INVENTION

Therefore, it has now been found that in an array of consumer products this use of two different primary indicia, namely a first and second primary indicia on a first and second consumer product, in combination with lesser indicia and unifying thematic elements educates the consumer as to the potential synergistic benefits that can be obtained by using the consumer products of the array. The first and second primary indicia each have their own unique consumer identification therewith, which when linked and combined through the use of the lesser indicia and the unifying thematic elements in the array, synergistically combine to educate and inform the consumers that the benefits features and/or attributes of each of the consumer products, as indicated by the presence of the first and second primary indicia in association with the consumer products, has been translated into the array of products. This education of the consumer is further enhanced by the presence of the discontinuous elements which combine with the first and second primary indicia to show that each product of the array is different and unique.

This unique combination of elements translates into an immediate consumer impression upon seeing the products of the array, such as in a television advertisement, in a print advertisement, on a web site, or even arranged in a store display. A consumer on seeing the lesser indicia and the unifying thematic elements would immediately realize that these products are part of an array of goods. A consumer on seeing the first and second primary indicia on each of the products and the discontinuous elements would also be able to readily identify the individual consumer products in the array as providing different consumer benefits. Furthermore, the consumer on seeing each of the first and second primary indicia on each of the products would recall the consumer identification possessed by each product and would understand and realize the array of products as a whole should be identified with all of these consumer identifications. This almost immediate identification and reinforcement that a consumer would have, thereby enables savings in labor, time and reduced, possibly even substantial reduced investment in marketing, advertising and the like, as the consumers on seeing the array of products already have been educated as to the synergistic benefits of the consumer products therein.

One aspect of the invention relates to an array of at least two consumer products comprising:

(a) a first consumer product having associated therewith a first principle indicia selected from branding, words, phrases, letters, characters, brand names, company names, company logos or symbols, logos, icons, designs, designer names, symbols, insignias, shapes and combinations thereof, wherein the first principle indicia has a first consumer identification therewith and a first consumer benefit; and (b) a second consumer product having associated therewith a second principle indicia selected from branding, words, phrases, letters, characters, brand names, company names, company logos or symbols, logos, icons, designs, designer names, symbols, insignias, shapes and combinations thereof, wherein the second principle indicia is different than the first principle indicia and has a second consumer identification therewith which is different than the first consumer identification and a second consumer benefit which is different than the first benefit; wherein both of the first consumer product and the second consumer product have in association therewith:

a lesser indicia;

at least two unifying thematic elements; and at least two discontinuous elements.

Another aspect of the invention relates to a method for displaying an array of laundry products for retail sale comprising the steps of (i) placing on a display in a store a first laundry product comprising an opaque container and a composition contained therein, wherein the opaque container comprises a first color, and first laundry product having associated therewith a first principle indicia selected from branding, words, phrases, letters, characters, brand names, company names, company logos or symbols, logos, icons, designs, designer names, symbols, insignias, shapes and combinations thereof; (ii) placing on the display a second laundry product comprising a translucent/transparent container and a colored composition contained therein, wherein the colored composition matches and/or coordinates with the first color, the second laundry product having associated therewith a second principle indicia selected from branding, words, phrases, letters, characters, brand names, company names, company logos or symbols, logos, icons, designs, designer names, symbols, insignias, shapes and combinations thereof, wherein both of the first laundry product and the second laundry product have a secondary indicia in association therewith, and the second laundry product is adjacent the first laundry product.

Another aspect of the invention relates to an array of laundry articles comprising:

(a) laundry cleaning product comprising:

(i) a laundry cleaning composition comprising a perfume;

(ii) a opaque container releasably containing the laundry cleaning composition;

(iii) at least one first label attached to the opaque container; and (iv) a first natural scent identifier located on the first label;

(b) a fabric care product comprising:

(i) a fabric care composition containing the perfume;

(ii) a container releasably containing the fabric care composition, wherein at least 20% of the total surface area of the container is clear or translucent;

(iii) at least one second label attached to the container; and (iv) a second scent identifier located on the second label;

wherein the first natural scent identifier is the same as the second natural scent identifier.

DETAILED DESCRIPTION OF THE INVENTION

Figure 1:
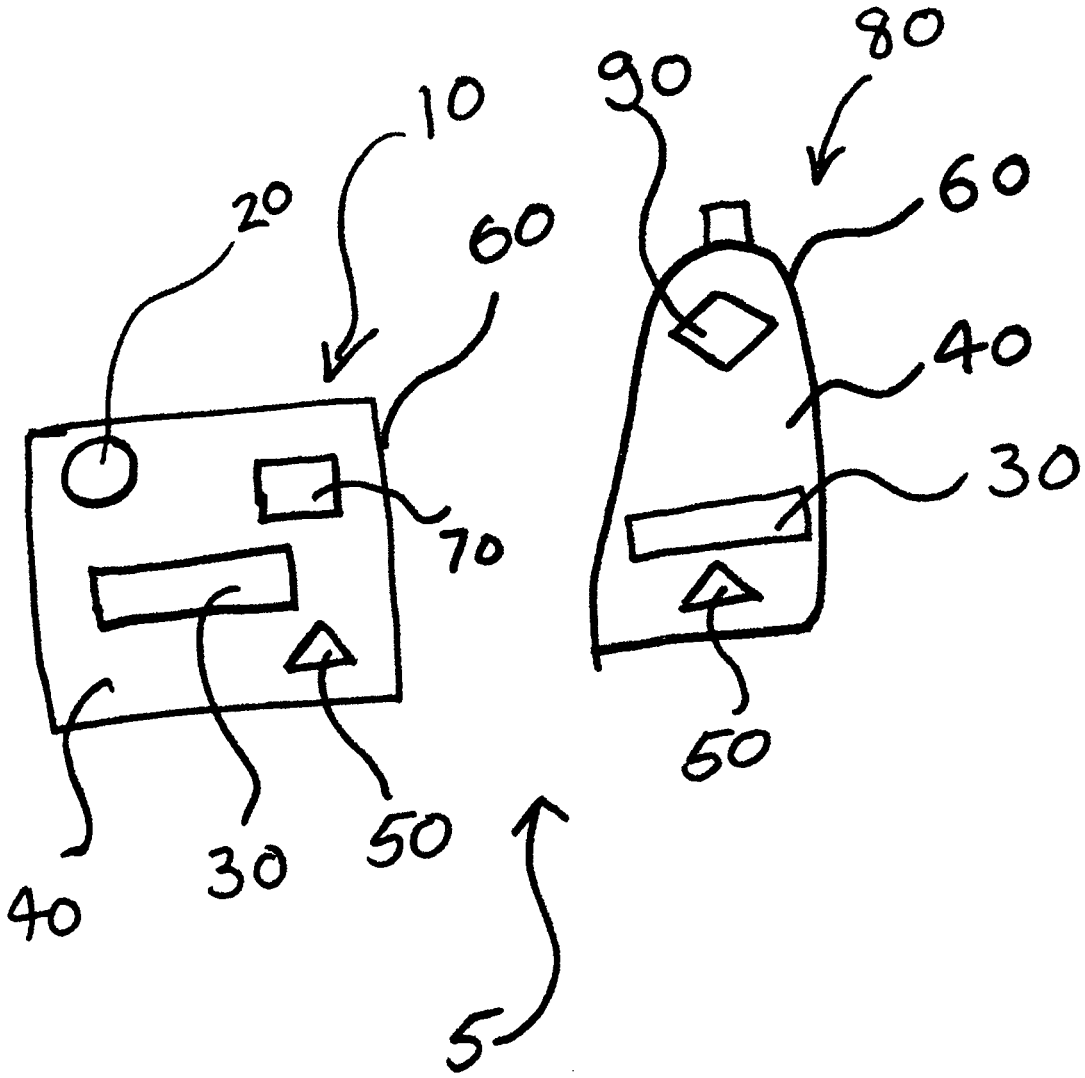
FIG. 1 is an illustrative example of a first array of consumer products in accordance with an embodiment of this invention.

A. Array of Consumer Products: One aspect of the present invention comprises an array of consumer products, specifically a first consumer product and a second consumer product, more specifically a first consumer product, a second consumer product and a third consumer product.

As used herein, "consumer product" refers to any product which is typically used by a consumer, such as, paper products, laundry products, kitchen products, bathroom products, automotive products, and personal products. Illustrative examples of such "consumer products" includes, solid laundry detergents, (i.e. granules, tablets, powders, pastes, and the like); liquid laundry detergent (including gels, liquid-gels and the like); light duty detergents; unit dose laundry detergents; bleaching compositions; dryer sheets; fabric softening compositions; pretreater compositions; pre-treatment devices; dye trapping sheets; fabric refreshing compositions paper towels, toilet tissue, facial tissue, paper plates, paper cups, writing paper, greaseproof paper, disposable dusting sheets, and wrapping paper, feminine hygiene products (such as, tampons, pads, adult incontinence products, interlabile products and the like), diapers, disposable wipes, aluminum foil, polymeric kitchen films, dish detergent, sponges, disposable plates, disposable cups, disposable tableware, scouring pads, mops, buckets, automatic dishwashing detergent compositions, automatic dishwashing rinse aids, water filters, water filter cartridges tile cleaners, toilet cleaners, floor cleaners, automotive polish, tire cleaner, automotive air fresheners, car was, automotive washing systems, hand soap, body wash, razors, shaving cream, body wash, shampoo, conditioner, face wash, conditioner, toothpaste, vitamins, medicaments, deodorant, tooth brushes, makeup, nail polish, lipstick, makeup remover, and the like.

As used herein, "laundry product" refers to in the broadest to include any product which is typically used in the laundry or imparts a laundry benefit, such as, fabric cleaning, whiteness maintenance, softening, freshness, scent, static control, absorbency, color care, or wrinkle control, and the like, to fabrics during the laundering process. In one optional embodiment the laundry product is selected from detergent compositions, for example, solid laundry detergents (i.e. granules, tablets, powders, pastes, and the like); liquid laundry detergent (including gels, liquid-gels and the like); light duty detergents; unit dose laundry detergents; bleaching compositions; dryer sheets; fabric softening compositions; pretreater compositions; pre-treatment devices; dye trapping sheets; and fabric refreshing compositions and the like.

In one optional embodiment, the consumer product, more specifically the second consumer product, is a fabric care composition that comprises a fabric conditioning composition. By way of example, fabric conditioning compositions are described in U.S. Pat. Nos. 4,424,134; 4,767,547; 5,460,736; 5,545,340; 5,545,350; 5,562,849; 5,574,179; 5,874,396; 5,998,359; 6,020,304; 6,022,845; 6,083,899; 6,093,691; and 6,103,678. In one embodiment, compositions of the present invention comprise a fabric softening active. In one embodiment, the fabric softening active is a quaternary ammonium compound.

In one alternative optional embodiment, the fabric softening active comprises a cationic starch. Suitable cationic starches are described at U.S. Pat. Appl. Pub. US 2004/0204337, published Oct. 14, 2004, at paragraphs 16-29. Other suitable fabric softeners actives are also described in US 2004/0204337 at paragraphs 30-79.

In one alternative optional embodiment, the fabric care composition is a "rinse added" composition, wherein the composition is added during a rinse cycle of an automatic washing machine. In another embodiment, the fabric care composition is a "wash-added" composition, wherein the composition is added at the initial, wash-cycle of an automatic washing machine.

In another optional embodiment, consumer product, more specifically the first consumer product, is a fabric care composition that comprises a cleaning composition. The term "cleaning composition" is used herein in the broadest sense and includes heavy duty liquid laundry detergent compositions, light duty liquid laundry detergent compositions, laundry pretreaters, products for pre-soaking laundry, laundry additives and combinations thereof. Examples of cleaning compositions are described in U.S. Pat. Nos. 4,515,705; 4,537,706; 4,537,707; 4,550,862; 4,561,998; 4,597,898; 4,968,451; 5,565,145; 5,929,022; 6,294,514; and 6,376,445.

The first consumer product has associated therewith a first principle indicia selected from branding, words, phrases, letters, characters, brand names, company names, company logos or symbols, logos, icons, designs, designer names, symbols, insignias, shapes and combinations thereof. Similarly, the second consumer product has associated therewith a second principle indicia selected from branding, words, phrases, letters, characters, brand names, company names, company logos or symbols, logos, icons, designs, designer names, symbols, insignias, shapes and combinations thereof, wherein the second principle indicia is different than the first principle indicia.

As used herein, "indicia" refers to scent, branding, packaging, properties, sound, words, phrases, letters, characters, brand names, company names, company logos or symbols, descriptions, logos, icons, designs, designer names, symbols, motifs, insignias, figures, marks, signals, colors, textures, shapes, tokens, advertisements, and combinations thereof.

As used herein, "in association with" means the indicia are either directly printed on the consumer product itself, a container/package itself, or a label attached to said consumer product and/or container/package and/or are presented in a different manner including, a brochure, print advertisement, electronic advertisement, and/or verbal communication, so as to communicate the indicia to a consumer.

The first consumer product also has a first consumer identification therewith. Similarly, the second consumer product has a second consumer identification therewith which is different than the first consumer identification. As used herein, "consumer identification" refers to a benefit, property, feature, image, scenario, or the like that is generally recognized by consumers as associated with a particular consumer product by. Illustrative examples of consumer identifications include: images, such as, woman soaking her hands in dish detergent recalls an association that COLGATE PALMOLIVE brand dish detergent is soft on your hands while you "do the dishes," a man who looks like a "lumber jack" using a paper towel in a kitchen recalls an association of BRAWNY brand paper towels, a teddy bear falling on to a hamper of folded clothing recalls an association of SNUGGLE brand fabric softener, and the like; scent, such as, the smell of a surface after PINESOL brand hard surface cleaner has been applied, the scent of JOHNSON & JOHNSON brand baby shampoo, and the like; sound, such as the "LOUIE THE FLY" jingle, the "I like AEROPLANE JELLY" song, "FROSTIES THEY'RE GRRR . . . GREAT" a tag line or sound bite recalls an association of a specific breakfast cereal, and the like; characters, such as words, terms, symbols, insignias, figures, marks, signals people, characters and/or other anthropomorphic representations that are associated with specific products, such as, the SNUGGLE BEAR, the BRAWNY MAN, TONY THE TIGER, BUDWISER FROGS, Mr. SHEEN, LOUIE THE FLY, the FRUIT OF THE LOOM "Fruit"; story, such as, BUD LIGHT "real men of genius" stories and the like; scenario, such as only product brand X can clean this mess; theme, such as, renewable energy, value, quality, renewable resources, and combinations thereof; and combinations thereof.

The first consumer product also has a first consumer benefit. Similarly, the second consumer product has a second consumer benefit which is different than the first consumer benefit. As used herein, "consumer benefit" refers to an advantage, property or the like that is possessed by a particular consumer product and provides useful result to a consumer. Illustrative examples of consumer benefits includes cleaning, softness, scent, ease of use, reliability, value, water conservation, energy conservation, protecting fabric fibers from damage, increasing the lifetime of fabrics, machine preservation, providing color care, preserving fabric integrity, anti-corrosion, anti-oxidant, anti-spotting, preserving fabric shape, static control, disinfecting, sanitization, germ control, mold control, mildew agent, antiviral, antimicrobial, odor control, anti-shrinkage, stain resistance, absorbency, maintaining the original or natural texture or feel of the garment and combinations thereof.

Both of the first consumer product and the second consumer product have in association therewith a lesser indicia. In one optional embodiment the lesser indicia is selected from scent, branding, packaging, properties, sound, words, phrases, letters, characters, brand names, company names, company logos or symbols, descriptions, logos, icons, designs, designer names, symbols, motifs, insignias, figures, marks, signals, colors, textures, shapes, tokens, advertisements and combinations thereof.

In one optional embodiment the lesser indicia connotes an emotive theme and/or mood. Illustrative examples of such indicia that connotes an emotive theme and/or mood includes, relax, relaxing, aromatherapy, enjoy, recline, calm, calming, sooth, soothing, spa therapy, massage, passion, vivacious, energetic, energize, empower, and the like and combinations thereof. In another optional embodiment the lesser indicia may comprise term or terms describing the scent or another property of the array of consumer products as well as connoting an emotive theme and/or mood. Illustrative examples of such indicia includes, passionate purple, relaxing lavender, vivacious violet, energetic red and the like.

In an alternative optional embodiment the lesser indicia comprises a logo constructed as a device from at least three groups of symbols, a first of the three groups representing one product category, a second of the three groups representing another product category, and a third of the three group representing corporate values. The device may be any suitable object, shape or graphical image, but more specifically is selected from alphanumeric symbols, shapes, forms letter, and combinations thereof. Additional information on the logo of this optional embodiment may be found in Pending U.S.

Patent Application Publication No. 2005/0256771 published on Nov. 17, 2005 to Coomber et al.

In another alternative optional embodiment the lesser indicia is suggestive and/or allutive of the scent of said first consumer product and said second consumer product.

In another more specific optional embodiment the lesser indicia has never previously been associated with either of the first or second consumer product, even more specifically the lesser indicia has never previously been associated with consumer products of the same category as the first or second consumer product.

In another alternative embodiment the lesser indicia may comprise a scent identifier, which is described in more detail herein.

In another alternative embodiment the lesser indicia may comprise a narrative scent descriptor, which is described in more detail herein.

In another alternative embodiment the lesser indicia may comprise a scent descriptor, which is described in more detail herein.

Both of the first consumer product and the second consumer product have in association therewith at least two unifying thematic elements. In other words each of the products comprising the array have in association therewith at least two unifying thematic elements. As used herein, "unifying thematic element" refers to a common benefit, property, feature, image, scenario, or the like that is shared by two or more products. Illustrative examples of unifying thematic elements includes, scent, branding, packaging, properties, sound, words, phrases, letters, characters, brand names, company names, company logos or symbols, descriptions, logos, icons, designs, designer names, symbols, motifs, insignias, figures, marks, signals, colors, textures, shapes, tokens, advertisements, and combinations thereof. An illustrative example would be an array of two consumer products where one of the unifying thematic elements is they are both the same color, or share the same perfume, and the like.

In one optional embodiment one or more of the unifying thematic elements connotes an emotive theme and/or mood. Illustrative examples of such a unifying thematic element that connotes an emotive theme and/or mood includes, relax, relaxing, aromatherapy, enjoy, recline, calm, calming, sooth, soothing, spa therapy, massage, passion, vivacious, energetic, energize, empower, and the like and combinations thereof. In another optional embodiment the unifying thematic element may comprise term or terms describing the scent or another property of the array of consumer products as well as connoting an emotive theme and/or mood. Illustrative examples of such indicia includes, passionate purple, relaxing lavender, vivacious violet, energetic red and the like.

In a specific optional embodiment the array of consumer products optionally comprises at least three unifying thematic elements.

In another more specific optional embodiment at least one of the thematic elements is suggestive and/or allutive of the scent of the first consumer product and the second consumer product.

In another more specific optional embodiment the unifying thematic elements are selected from words, phrases, brand names, company names, descriptions, designer names, advertisements, and combinations thereof, and wherein one of the two unifying indicia is in one or more than one language.

In another more specific optional embodiment the unifying thematic elements have never previously been associated with either of the first or second consumer product, even more specifically the unifying thematic elements has never previously been associated with consumer products of the same category as the first or second consumer product.

In another alternative embodiment one or more of the unifying thematic elements may comprise a scent identifier, which is described in more detail herein.

In another alternative embodiment one or more of the unifying thematic elements may comprise a narrative scent descriptor, which is described in more detail herein.

In another alternative embodiment one or more of the unifying thematic elements may comprise a scent descriptor, which is described in more detail herein.

Both of the first consumer product and the second consumer product have in association therewith at least two discontinuous elements. As used herein, "discontinuous elements" refers to a benefit, property, feature, image, scenario, or the like that is not shared by two or more products. Illustrative examples of discontinuous elements includes, scent, branding, packaging, properties, sound, words, phrases, letters, characters, brand names, company names, company logos or symbols, descriptions, logos, icons, designs, designer names, symbols, motifs, insignias, figures, marks, signals, colors, textures, patent marking statement, shapes, tokens, advertisements, and combinations thereof. An illustrative example would be an array of two consumer products where one of the discontinuous elements is the consumer products are different colors, that is, colors that are not matching and/or contrasting, or the products are different in shape.

Another illustrative example of one of the discontinuous elements would be the presence of one feature, such as a scent, branding, packaging, properties, sound, words, phrases, letters, characters, brand names, company names, company logos or symbols, descriptions, logos, icons, designs, designer names, symbols, motifs, insignias, figures, marks, signals, colors, textures, patent marking statement, shapes, tokens, advertisements, and combinations thereof, on say the first consumer product and the absence of this feature on say the second consumer product. An illustrative example of this would be, for example the presence of a patent marking statement on one product and the absence of such a statement on the other product(s) of the array. Another illustrative example would be say the presence of a narrative scent descriptor on one product and the absence of a narrative scent descriptor on the other product(s) of the array.

In another alternative embodiment one or more of the discontinuous elements may comprise a scent identifier, which is described in more detail herein.

In another alternative embodiment one or more of the discontinuous elements may comprise a narrative scent descriptor, which is described in more detail herein.

In another alternative embodiment one or more of the discontinuous elements may comprise a scent descriptor, which is described in more detail herein.

In another optional specific embodiment the array of consumer products further comprises a third consumer product having associated therewith a third principle indicia words, phrases, letters, characters, brand names, company names, company logos or symbols, logos, icons, designs, designer names, symbols, insignias, shapes and combinations thereof, wherein the third principle indicia has a third consumer identification therewith and a third consumer benefit; and wherein all of the first consumer product, second consumer product and the third consumer product have in association therewith: (i) a lesser indicia; (ii) at least two unifying thematic elements; and (iii) at least two discontinuous elements. In one more specific aspect the third principle indicia may be the same as or different than the second principle indicia.

It is this use of two different primary indicia, namely the first and second primary indicia, in combination with the lesser indicia and the unifying thematic elements that educates the consumer as to the potential synergistic benefits that can be obtained by using the consumer products of the array. The first and second primary indicia each have their own unique consumer identification therewith, which when linked and combined through the use of the lesser indicia and the unifying thematic elements in the array, synergistically combine to educate and inform the consumers that the benefits features and/or attributes of each of the consumer products, as indicated by the presence of the first and second primary indicia in association with the consumer products, has been translated into the array of products. This education of the consumer is further enhanced by the presence of the discontinuous elements which combine with the first and second primary indicia to show that each product of the array is different and unique.

This unique combination of elements translates into an immediate consumer impression upon seeing the products of the array, such as in a television advertisement, in a print advertisement, on a web site, or even arranged in a store display. A consumer on seeing the lesser indicia and the unifying thematic elements would immediately realize that these products are part of an array of goods. A consumer on seeing the first and second primary indicia on each of the products and the discontinuous elements would also be able to readily identify the individual consumer products in the array as providing different consumer benefits. Furthermore, the consumer on seeing each of the first and second primary indicia on each of the products would recall the consumer identification possessed by each product and would understand and realize the array of products as a whole should be identified with all of these consumer identifications. This almost immediate identification and reinforcement that a consumer would have, thereby enables savings in labor, time and reduced, possibly even substantial reduced investment in marketing, advertising and the like, as the consumers on seeing the array of products already have been educated as to the synergistic benefits of the consumer products therein.

In another specific optional the embodiment of the present invention the first consumer product may comprise a first package and the second consumer product comprises a second container different than the first container. This difference may takes any form such as size, shape, foot print, volume, material, texture, opaque, transparent/translucent, waste soluble, water insoluble, and is specifically a difference that can be ascertained by a consumer or a user of the product, for example, by sight, touch and the like and combinations thereof.

The containers, when present, may be of any, size, shape, volume, material, texture, opaque, transparent/translucent, waste soluble, water insoluble, and the like. In one optional embodiment the first container is an opaque container. This opaque container more specifically comprises a first color and more specifically releasably contains a composition contained therein. In another optional embodiment the second container comprises a translucent/transparent container. This translucent/transparent container more specifically releasably contains a colored composition contained therein, wherein the colored composition matches and/or coordinates with the first color.

As used herein, "opaque" refers to a transmittance of less than about 25% transmittance of all wavelengths of electromagnetic radiation in the visible spectrum, more specifically a transmittance of less than about 20%, even more specifically less than about 15%, even more specifically still less than about 10%, yet even more specifically still less than about 5% in the visible part of the electromagnetic spectrum. Alternatively, a container, composition and the like may be considered opaque if the absorbency of the bottle of the visible electromagnetic spectrum is greater than about 0.6.

As used herein, "translucent/transparent" refers to a transmittance of greater than about 25% transmittance of at least one wavelength of electromagnetic radiation in the visible spectrum, more specifically a transmittance of more than about 25%, even more specifically more than about 30%, even more specifically still more than about 40%, yet even more specifically still more than about 50% in the visible part of the electromagnetic spectrum. Alternatively, a container, composition and the like may be considered translucent/transparent if the absorbency of the bottle of the visible electromagnetic spectrum is less than about 0.6. An illustrative example of a translucent/transparent object would be a clear bottle or clear composition. Another example of a translucent/transparent object would be a bottle or composition which is colored, such having a blue or red tint, but still has a transmittance of greater than about 25% transmittance of at least one wavelength of electromagnetic radiation in the visible spectrum.

Additional illustrative information and examples of translucent/transparent and opaque containers and/or compositions and the like can be found in U.S. Pat Nos. 6,630,437 issued to Murphy et al; 6,756,350 issued to Giblin et al; and 6,159,958 issued to Bae-Lee et al.

As used herein, "matches" refers to property, such as color, shape, texture, and the like, which are substantially the same or similar, more specifically identical or near identical, in two different products. While it is to be understood that the term specifically includes similar or identical colors, it is also understood to include shades, tones, hues and the like, of a color. It is also to be understood that the term "color" not only includes all the colors of the visible spectrum, namely, red, orange, yellow, green, blue, teal, brown, purple, lilac, sea green, tan, navy, violet, pink and the like, it also includes all shades, tones, hues and the like, such as dark blue, light, blue, light green, etc, of these colors, as well as black, white, and grey and all shades, tones, hues and the like of these.

As used herein, "coordinates" refers to property, such as color, shape, texture, and the like, which are complimentary or provide a positive and pleasing contrast of one property to another.

In another more specific optional embodiment, when the array of products comprises the optional third consumer product, the third consumer product may optionally comprise a third container. This optional third container may be the same or different than the first container. The third container may also be the same or different than the second container. The third container may be of any size, shape, foot print, volume, material, texture, opaque, transparent/translucent, waste soluble, water insoluble.

The containers, when present, may comprise a material, namely the first container comprises a first material, independently, the second container comprises a second material and independently the third container comprises a third material. The first, second and third material, when present, may be the same or different, and may be selected from: metal, such as, aluminum, steel, brass, copper, tin, and the like; wood; laminate, such as, wood laminates, polymeric laminates, such as, carbon fiber laminates, and the like and combinations thereof; paper; cardboard, such as, fiberboard, cardboard and the like and combinations thereof; polymer, such as, polypropylene, polyacrylates, synthetic rubbers, natural rubbers, polyethylene, polycarbonate, polyamide, polyethylene terephthalate, polyvinylchloride, polystyrene, high density polyethylene, polymethylmethacrylate, polycarbonate, diethyleneglycol bisarylcarbonate, polyethylene naphthalate, polyvinyl chloride, polyurethane, epoxy resin, polyamide-based resins, low density polyethylene, styrene butadiene copolymers, acrylonitrile, acrylonitrile-butadiene copolymer, cellulose acetate butyrate and mixtures thereof; fabric, such as, cotton, hemp, nonwoven materials, wool, polyester fabrics, poly cotton blends and the like and combinations thereof; ceramic, such as, terracotta, china, "redware", majolica and the like and combinations thereof; glass, such as, Pyrex, safety glass, laminated glass and the like and combinations thereof; film, such as, polymeric film laminates, high density polyethylene films, low density polyethylene films, medium density polyethylene films, and the like and combinations thereof; and combinations thereof.

Clear or translucent plastics useful herein include those that are colored or tinted in such a manner that the light transmission of the plastic is preserved. Polyethylene terephthalate is a preferred plastic. Likewise the materials may be processed in single or multiple layers. Because a variety of different materials may be used in the construction of the containers of the present invention the materials selected will be based on the intended end use and characteristics required of such a container.

As noted previously, when present, the first, second and third containers may be of any shape. In one more specific embodiment the first container has a shape selected from cylindrical, tubular, conical, frustum of a cone, spheroidal, cubodial, pyramidoidal, and combinations thereof. In another more specific embodiment the second container has a shape selected from cylindrical, tubular, conical, frustum of a cone, spheroidal, cubodial, pyramidoidal, and combinations thereof. In another more specific embodiment the third container has a shape selected from cylindrical, tubular, conical, frustum of a cone, spheroidal, cubodial, pyramidoidal, and combinations thereof.

In one optional embodiment, a container, such as the first container, may be a water dissolvable unit dose (such as, one made from polyvinyl alcohol film), the composition releasably contained therein would be a liquid or solid laundry detergent.

A suitable container is described in U.S. Provisional Application Ser. No. 60/541,114, filed Feb. 2, 2004, entitled "CONTAINER HAVING A HELICAL GRIP," to Brian Floyd, and the non-provisional application thereto; U.S. Pat. Nos. 4,550,862; and 4,981,239. Other suitable containers, packages or parts thereof, may be found in U.S. Design Patent Nos. Des. 403,578; Des. 414,421; Des. 425,792; Des. 491,071; Des. 466,816; Des. 457,064; Des. 439,520; Des. 286,602; Des. 429,643; Des. 472,151; Des. 417,622; Des. 322,748; and Des. 509,748; and in U.S. Pat. Nos. 4,732,315; 6,021,926; 6,269,962; 4,846,359; 6,960,375; 6,223,945; 6,902,077; 6,824,001; 6,959,834; 6,491,165; 5,050,742; 6,705,465; 6,630,437; 6,756,350; 6,366,402; 6,159,958; and 6,601,705.

In another embodiment of the present invention the array of consumer products may optionally specifically be an array of laundry articles. More specifically this array of laundry articles comprises:

(a) laundry cleaning product comprising:
  (i) a laundry cleaning composition comprising a perfume;
  (ii) a opaque container releasably containing the laundry cleaning composition;
  (iii) at least one first label attached to the opaque container; and
  (iv) a first natural scent identifier located on the first label;

(b) a fabric care product comprising:
  (i) a fabric care composition containing the perfume;
  (ii) a container releasably containing the fabric care composition, wherein at least 20% of the total surface area of the container is clear or translucent;
  (iii) at least one second label attached to the container; and
  (iv) a second scent identifier located on the second label;

wherein the first natural scent identifier is the same as the second natural scent identifier.

In another more specific optional embodiment, an array of laundry articles may further comprise a second fabric enhancer product comprising:

(i) a second fabric care composition, comprising a perfume, more specifically a fabric softener composition releasably contained on a nonwoven substrate;
(ii) a second opaque container releasably containing the second fabric enhancer, more specifically the second opaque comprises cardboard and/or fiberboard;
(iii) a third natural scent identifier located on second opaque container; and wherein the third natural scent identifier is the same as the second natural scent identifier and the first natural scent identifier.

A label provides a convenient point-of-purchase site for the principle indicia, lesser indicia, unifying thematic elements, discontinuous elements and the like and combinations thereof. The term "label" is used herein in the broadest sense to include the tangible medium that may optional contain one or more of the principle indicia, lesser indicia, unifying thematic elements, discontinuous elements and the like and combinations thereof may be optionally expressed including, by way of illustrative example, the placing of principle indicia element directly on to a container (e.g., printing or molding), the printing of lesser indicia on a substrate wherein the substrate is placed on the outside surface of the container, or packaging such as boxes that enclose the container. In one embodiment, an olfactory scent descriptor may also be provided via a label (e.g., packaging). For example, the label itself may be scented, i.e., comprise the scent.

The optional labels of the present invention may generally mimic the shape of the container. Illustrative examples of suitable label include, partially wrap-around labels, wrap-around labels, shrink-wrap labels, stickers, in-mold labels hang-tags, labels conveying the name of the product and combinations thereof.

In one optional specific embodiment, the label is a clear substrate such that at least one of principle indicia, lesser indicia, unifying thematic elements, and/or discontinuous elements, may be printed on to the label and the container or composition therein, if the container is transparent/translucent is substantially visible by the consumer through the label where the print of at least one of principle indicia, lesser indicia, unifying thematic elements, discontinuous elements is absent. Without wishing to be bound by theory, a clear label may maximize the color of the composition or the tint of the container in communicating to the consumer.

In another embodiment, the label has a background color to further communicate to the user. For example, if the scents or scent identifiers are magnolia and orange, the label may have an orange background color to further communicate this scent experience to the user given the visual association of an orange color to orange fruit and/or orange blossoms and hence the orange scent.

In another specific optional embodiment, one or more of the principle indicia, lesser indicia, unifying thematic elements, discontinuous elements are printed directly on the container. In another embodiment, one or more of the principle indicia, lesser indicia, unifying thematic elements, discontinuous elements are embossed on the container.

In one optional embodiment, the label is "shrink wrapped" on the container. In another optional embodiment, the label is adhered to the container by an adhesive.

As used herein, "scent identifier" refers to an identification of the scent of the product, more specifically identifying the scent of any perfume present.

As used herein, "scent descriptor" refers to a description of the scent of the product, more specifically describing the scent of any perfume present.

A "narrative scent descriptor" is used in the broadest sense to include a narrative that describes (either in writing or orally) a scent or scent identifier; and optionally, elicits a certain emotional experience or mood. In one optional embodiment, the narrative scent descriptor comprises at least five words; in another optional embodiment, at least ten words; in yet another optional embodiment, at least fifteen words. In another optional embodiment, the narrative scent descriptor comprises at least one sentence. In another optional embodiment, the narrative scent descriptor comprises at least two sentences.

For example, if the scents or scent identifiers are vanilla and lavender, a narrative scent descriptor may read as the following: "There aren't many times when I can relax and unwind. Those are the little moments I treasure for myself. Like each time I experience the aroma of rich vanilla and fresh lavender. It contains essentials oils for a warm and comforting scent experience."

In another example, if the scents or scent identifiers are Morning Glory & Honeysuckle, the narrative scent descriptor may read as the following: "There's something about the day's first rays of sunshine that make me feel really alive, energized. I'm reminded of that feeling whenever I catch the scent of sweet honeysuckle and morning glory. It contains essential oils for a bright and uplifting scent experience."

In yet another example, if the scents or scent identifiers are Water Lily and Jasmine, the narrative scent descriptor may read as the following: "To me nothing's as refreshing as water—whether it's a day near the ocean, a dip into a cool mountain stream, or the sound of a cascading waterfall. Whenever I catch the enticing essence of water lily and jasmine from that feeling washes over me. It contains essential oils for a crisp and refreshing scent experience."

In yet another example, if the scents or scent identifiers are Magnolia and Orange Blossom, the narrative scent descriptor may read as the following: "At times the pace of my life gets hectic, but I always try to keep my center grounded. Whenever I catch the scent of magnolia and orange blossom, a sense of calm washes over me. It contains essential oils for a balancing and harmonizing scent experience."

As used herein "perfume" refers to in its broadest sense to include any substance that diffuses or imparts an agreeable or attractive scent. In one specific embodiment, the perfume comprises at least one essential oil. In another specific embodiment, the perfume comprises an extract.

A "scent identifier" identifies the scent from the perfume. In one embodiment, the scent identifier comprises words, in another embodiment, less than three words. As used herein, a "scent identifier" identifies the scent from the perfume. As used herein, a "scent identifier" identifies the scent from the perfume.

In one embodiment, the perfume imparts a natural scent (irrespective of whether the composition of perfume is in fact from a natural source). In turn, the term "natural scent identifier," as used herein, is scent identifier that communicates to the consumer a natural source that includes flowers fruits, nuts, berry, spices, and plants. For purposes of clarification, a "mountain spring," although found in nature, does not impart a scent in nature (or at least one recognized by consumers) and thus is not considered a "natural scent identifier" as the term is herein defined. Surprisingly, the following natural scents and respective scent identifiers are preferred among consumers: vanilla, lavender, lilac, honeysuckle, rose, gardenia, jasmine, freesia, green apple, magnolia, lily of the valley, orchid, melon, violet, lily, pear, morning glory, chamomile, cucumber, almond, mandarin, mint, lemongrass, lime, snowflower, grapefruit, juniper, peony, sandalwood, tea tree, moonflower, lotus flower, iris, ylang ylang, cedarwood, ginger, green tea, patchouli, geranium, rosemary, tuberose, chrysanthemum, verbena, neroli, bergamot, thyme, marigold, bamboo, and vetyver, more preferably vanilla, lavender, lilac, honeysuckle, melon, gardenia, freesia, and rose. The perfume composition imparting a natural scent may be comprised of natural or non-natural perfume ingredients, or mixtures thereof.

In one embodiment, the perfume comprises an essential oil. Without wishing to be bound by theory, a perfume and a scent identifier comprising an essential oil is particularly useful for creating a scent experience because the scent identifier clearly communicates to the consumer what the scent experience will be and the essential oil in the composition reinforces the consumer's expectation. In one embodiment, the scent identifier comprises the term "essential oil."In another embodiment, the scent identifier comprises the term "extract."

One aspect of the invention provides a perfume that diffuses or imparts at least two scents but only two scent identifiers; alternatively the perfume diffuses or imparts at least three scents but only three scent identifiers. Without wishing to be bound theory, two scent identifiers describing two scents are more attractive to a larger consumer audience than one scent identifier describing one scent given the broadening range of appeal that two different scents offer and perhaps the synergy or complementary effect that two scents represent (or at least are perceived to represent); however, more than three scent identifiers describing more than three scents potentially confuses the consumer as to what the overall scent experience is thereby hindering the consumer's ability to identify the desired scent experience.

In one optional embodiment the fabric care composition may comprise about 0.05% to about 15%, specifically from about 0.1% to about 10%; more specifically from about 0.3% to about 6%, and even more specifically from about 0.5% to about 4%, by weight of the said fabric care composition of a perfume to provide an improved scent experience. An improved scent experience may be given by a perfume comprising one or more of the perfume ingredients types chosen from: (1) enduring perfume ingredients, to provide improved dry fabric odor; (2) blooming perfume ingredients, to provide increased impact during use; (3) low odor detection thresholds ingredients, to provide impactful neat product odor; (4) pro-perfume; (5) natural oil perfume ingredient; and (6) mixtures thereof. Some of the perfume ingredients belong to one or more of the perfume ingredient type categories described below and these are also acceptable for use in the present invention.

In one optional embodiment, the consumer products of the present invention comprises at least a natural oil perfume ingredient.

Enduring Perfume Ingredients: An enduring perfume ingredient is characterized by its boiling point (B.P.) and its octanol/water partitioning coefficient (P). The octanol/water partitioning coefficient of a perfume ingredient is the ratio between its equilibrium concentrations in octanol and in water. The perfume ingredients of this invention have a B.P., measured at the normal, standard pressure, of about 250° C. or higher, preferably more than about 260° C.; and an octanol/water partitioning coefficient P of about 1,000 or higher. Since the partitioning coefficients of the perfume ingredients of this invention have high values, they are more conveniently given in the form of their logarithm to the base 10, logP. Thus the enduring perfume ingredients of this invention have a calculated ClogP of about 3 or higher, preferably more than about 3.1, and even more preferably more than about 3.2. By way of example, enduring perfume ingredients are described in U.S. Pat. No. 6,491,728. In one embodiment of the present invention, the perfume comprises at least about 1%, preferably at least about 5%, more preferably at least about 10%, even more preferably at least about 25%, still more preferably at least about 50% even more preferably still at least about 70%, and most preferably at least about 75% of enduring perfume ingredients by weight of the perfume.

Blooming Perfume Ingredients: Blooming perfume ingredients are those having a boiling point (B.P.) equal to or lower than about 250° C., more preferably equal to or lower than about 250° C., wherein the B.P. is measured at the normal standard pressure. By way of example, blooming perfume ingredients are described at U.S. Pat. Nos. 6,194,362 and 6,143,707.

In one embodiment, the perfume of the present invention comprises at least about 3 different blooming perfume ingredients, preferably at least about 4 different blooming perfume ingredients, more preferably at least about 5 different blooming perfume ingredients, and even more preferably at least about 6 different blooming perfume ingredients.

The boiling points of many perfume ingredients are given in, e.g., "Perfume and Flavor Chemicals (Aroma Chemicals)," S. Arctander, published by the author, 1969. Other boiling point values can be obtained from different chemistry handbooks and databases, such as the Beilstein Handbook, Lange's Handbook of Chemistry, and the CRC Handbook of Chemistry and Physics.

In the perfume art, some materials having no odor or very faint odor are used as diluents or extenders. Illustrative examples of these materials are dipropylene glycol, diethyl phthalate, triethyl citrate, isopropyl myristate, and benzyl benzoate. These materials are used for, e.g., diluting and stabilizing some other perfume ingredients. For purposes of this invention, these materials are not counted as a "blooming perfume ingredient."

Pro-perfume: When used herein, perfume can also include a pro-perfume. The term "pro-perfume" is herein defined to include: pro-fragrances, pro-perfumes, pro-accords, and mixtures thereof. Such pro-perfume may include acetal pro-perfumes, ketal pro-perfumes, ester pro-perfumes (e.g., digeranyl succinate), hydrolyzable inorganic-organic pro-perfumes, and mixtures thereof. These pro-perfumes are generally nonvolatile materials that release or convert to a perfume material, preferably a blooming perfume ingredient, as a result of, e.g., simple hydrolysis, or may be pH-change-triggered pro-perfumes (e.g. triggered by a pH drop) or may be enzymatically releasable pro-perfumes, or light-triggered pro-perfumes. The pro-perfumes of the present invention can exhibit varying release rates depending upon the pro-perfume chosen. Pro-perfumes are described in the following: U.S. Pat. No. 5,378,468; U.S. Pat. No. 5,626,852; U.S. Pat. No. 5,710,122; U.S. Pat. No. 5,716,918; U.S. Pat. No. 5,721,202; U.S. Pat. No. 5,744,435; U.S. Pat. No. 5,756,827; U.S. Pat. No. 5,830,835; U.S. Pat. No. 5,919,752; WO 00/02986 published Jan. 20, 2000; and WO 01/04248 published Jan. 18, 2001.

Low Odor Detection Threshold Perfume Ingredients: When used herein, perfume may include low odor detection threshold perfume ingredients. As used herein, the "odor detection threshold" of a perfume ingredient is the lowest vapor concentration of that perfume ingredient which can be olfactorily detected. The odor detection threshold and some odor detection threshold values are discussed in, e.g., "Standardized Human Olfactory Thresholds", M. Devos et al, IRL Press at Oxford University Press, 1990, and "Compilation of Odor and Taste Threshold Values Data", F. A. Fazzalari, editor, ASTM Data Series DS 48A, American Society for Testing and Materials, 1978. Illustrative examples of low odor detection threshold perfume ingredients are given in U.S. Patent Application Publication No. 2003/0104969 A1. In one embodiment the perfume comprises at least one low odor detection threshold perfume ingredient, more preferably at least two low odor detection ingredient.

Natural Perfume Oil Ingredients: A natural perfume oil ingredient is one that has a natural plant or animal source, preferably a plant source, or an oil that is a synthetic copy of a natural perfume oil. For the present invention, natural perfume oils derived from a natural source are preferred for authentically creating a scent that most closely matches verbal or visual scent descriptors. In another aspect of the present invention, synthetic copies of the natural scents are preferred when economizing the formula is a consideration. The perfume composition of fabric care products of the present invention preferably include at least one natural perfume oil ingredient from a natural source or a synthetic copy. Arctander, Steffen, "Perfume and Flavor Materials of Natural Origin," 1960, Elizabeth, N.J. USA.

Retail display: The present invention also relates to retail displays comprising the array of consumer products as described herein. In one specific embodiment the array is an array of laundry of laundry products, more specifically a first laundry product and a second laundry product.

In another optional aspect of the invention, in order to present greater consistency with respect to the top height of the consumer products on the display, one or more of the consumer products forming the array will be displayed on a support or "podium." In a more specific form of this aspect of the invention, the podium will be used to support a "shorter" consumer product (or consumer products) that is (are) displayed alongside "taller" consumer products. It is believed, while not wishing to be limited by theory, that the use of such a podium in this manner presents a more attractive and cohesive display.

Where a podium is used, the face of the podium may more specifically be used to display one or more of the first principle indicia, the second principle indicia, the lesser indicia, one or more of the unifying elements, one or more of the discontinuous elements text and/or symbols that further enhances the customer-facing display and combinations thereof. The podium, when present, may be multi-tiered.

In another specific optional aspect of the invention, the display may comprise a shelving unit. This shelving unit may be free standing, designed to be placed on existing retail shelving or the like. It may be advantageous for the manufacturer of the consumer products to include such a shelving unit for use at retail, since a custom shelving unit may create a preferred setting for the array of consumer products. In a more specific form, the shelving unit will be sized to fit comfortably within the specific confines of standard retail shelving and will be shaped and colored to emphasize the cohesive nature of the array of consumer products that are placed in the shelf as discussed herein.

Another aspect of the present invention related to methods of displaying an array of consumer products for retail sale, more specifically laundry products.

Figures: FIGS. 1-6 have been included as they provide additional and illustrative information on the possible arrays, displays and methods of the present invention.

FIG. 1, is an array of two consumer products 5, comprising a first consumer product 10, having a first primary indicia in association therewith 20 and a second consumer product 80 having a second primary indicia in association therewith 90. In one alternative illustrative embodiment first consumer product 10 is a package of household sponges or similar household cleaning products, such as, paper towels, disposable wipes, and the like and the second consumer product 80 is a liquid dish detergent or similar household cleaning product, such as, hard surface cleaner, automatic dishwashing detergent, floor cleaning composition and the like.

The lesser indicia is in association therewith 30 both the first consumer product 10, and the second consumer product 80. The first consumer product 10 and second consumer product 80 have in association with both of the at least two unifying thematic elements 40, and 50. In the example array illustrated in FIG. 1, the unifying thematic element 40 is the color of the packages, which are matching; in this case the colors are the same. In an alternative, but not illustrated example the unifying thematic element could be a coordinating color or colors. In another alternative not illustrated example the unifying thematic element could be that the first consumer product 10, is a color and the second consumer product 80 is transparent/translucent and the product, such as a composition releasably contained in the second consumer product 80 matches and/or coordinates with the color of the first consumer product 10.

Additionally, in the example array illustrated in FIG. 1, the unifying thematic element 50 is an icon, such as, a picture of a candle, some flowers, the sun, a dancing bear, and the like, which is the same on both consumer products 10 and 80. In an alternative, but not illustrated example this unifying thematic element could be a designer name or the like.

The first consumer product 10 and second consumer product 80 also have in association with both of the at least two discontinuous elements 60, and 70. In the example array illustrated in FIG. 1, the discontinuous element 60 is the shape of the packages, which are different. In an alternative, but not illustrated example the discontinuous element could be footprint of the packages, or even the volume of the packages. Additionally, in the example array illustrated in FIG. 1, the discontinuous element 70 is narrative scent descriptor which is present only on the first consumer products 10 and not present on the second consumer product 80. In an alternative, but not illustrated example this discontinuous element could be a first narrative scent descriptor or the like present on the first consumer products 10 and a second narrative scent descriptor which different to the first narrative scent descriptor, on the second consumer product 80.

Figure 2:
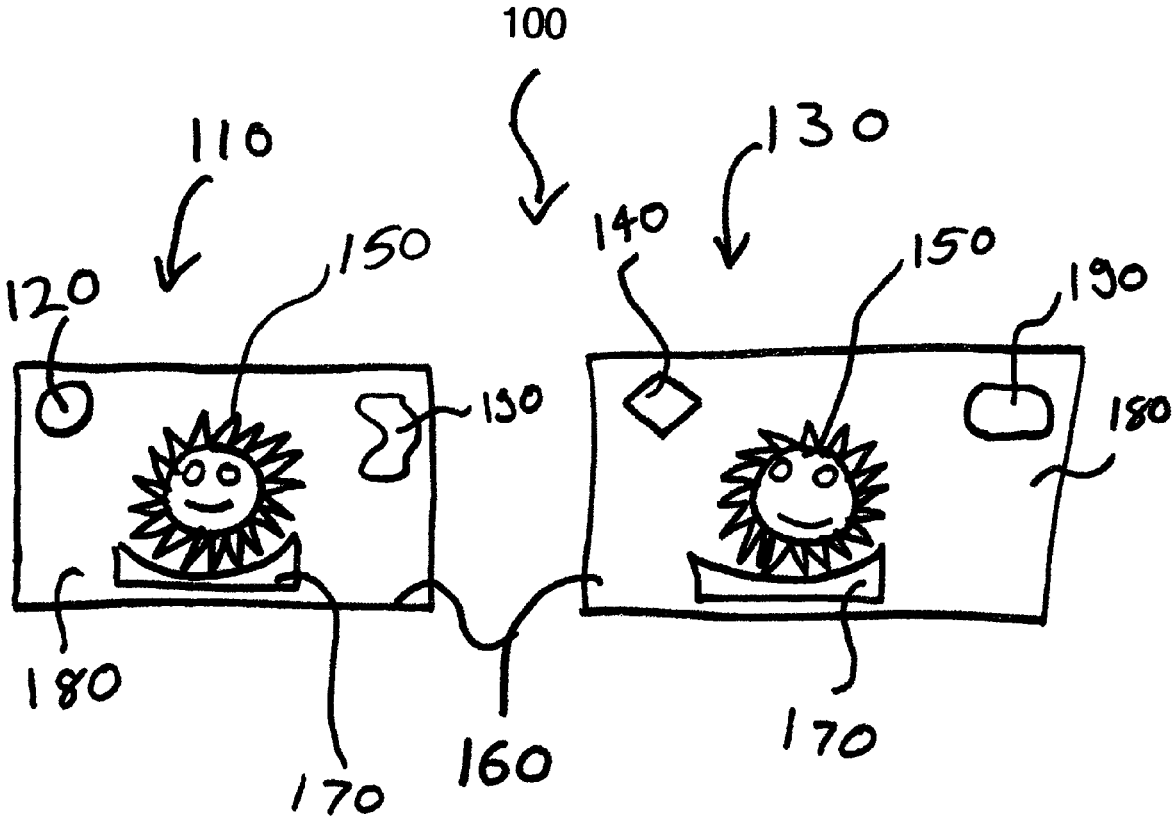
FIG. 2 is an illustrative example of another array of consumer products in accordance with an embodiment of this invention.

FIG. 2, is another array of at least two consumer products 100, comprising a first consumer product 110, having a first primary indicia in association therewith 120 and a second consumer product 130 having a second primary indicia in association therewith 140. In one alternative illustrative embodiment first consumer product 110, is a package of tampons or similar interlabial feminine hygiene products and the second consumer product 130 is maxi pads, panty liners or similar feminine hygiene products.

The lesser indicia is in association therewith 150 both the first consumer product 110, and the second consumer product 130. In this example the lesser indicia 150 is an anthropomorphic representation of the sun. In an alternative illustrative embodiment, not included in the figures, the lesser indicia could be an anthropomorphic representation of other objects, both animate and inanimate, such as, flowers, rocks, streams, buildings and the like, or an animals, such as, bears, llamas, wombats, turtles, cats, dogs, and/or automobiles and the like and combinations of all of these, such as, a wombat sitting by a stream under the stars, or a elephant driving an automobile, and the like and combinations thereof.

The first consumer product 110 and second consumer product 130 have in association with both of the at least two unifying thematic elements 160, and 170. In the example array illustrated in FIG. 2, the unifying thematic element 160 is the packages or container, which are identical in color, i.e. the colors are matching. In an alternative, but not illustrated example, the unifying thematic element could be coordinating colors.

Additionally, in the example array illustrated in FIG. 2, the unifying thematic element 170 is the scent descriptor, or scent identifier, such as, words identifying the scent, for example, lavender when the products scent is lavender or orange when the products scent is orange, which is the same on both consumer products 110 and 130. In an alternative, but not illustrated example this unifying thematic element 170 could be a graphical or pictorial representation of the scent, such as, a picture of a blackberry to indicate a blackberry scented product, and this image would appears in association with all consumer products in the array.

The first consumer product 110 and second consumer product 130 also have in association with both of the at least two discontinuous elements 180, and 190. In the example consumer product array 100 illustrated in FIG. 2, the discontinuous element 180 is the color of the packages, which are different and do not match and/or contrast. Additionally, in the example array illustrated in FIG. 2, the discontinuous element 190 is the icons, which are different on first consumer products 110 than the icon present on the second consumer product 130. These icons 190 could be different in appearance, such as color shape, etc., but contain the same letters, words and or phrases. Alternatively, the icons 190 could be entirely different, serving different purposes.

Figure 3:
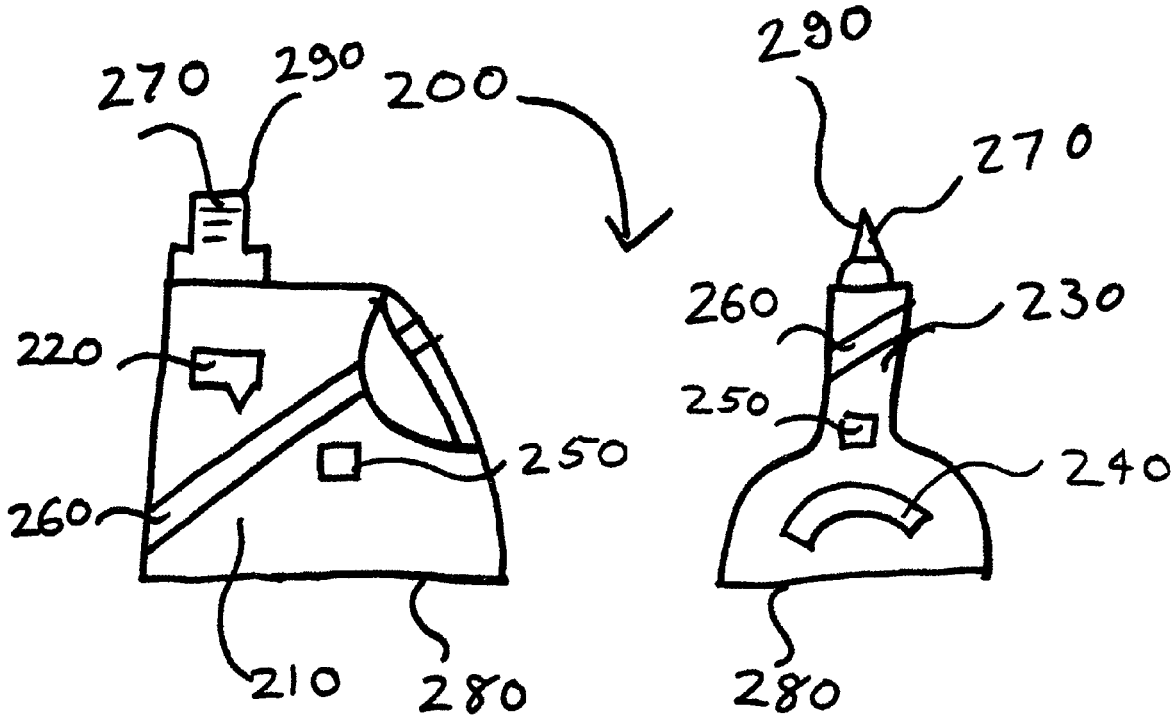
FIG. 3 is an illustrative example of yet still another array of consumer products in accordance with an embodiment of this invention.

FIG. 3, is another array of at least two consumer products 200, comprising a first consumer product 210, having a first primary indicia in association therewith 220 and a second consumer product 230 having a second primary indicia in association therewith 240. In one alternative illustrative embodiment first consumer product 210, is a packaged laundry product, such as, liquid laundry detergent, bleaching composition, solid laundry detergent, pretreater, and the like and the second consumer product 230 is a fabric enhancing product or the like, such as, fabric softener, ironing aid, anti static agent, water softener and the like.

The lesser indicia is in association therewith 250 both the first consumer product 210, and the second consumer product 230. In this illustrative example, the lesser indicia 250 is a brand name, such as, wizzo, or crunchy. In one alternative embodiment the lesser indicia 250 could be a brand name which is arbitrary or fanciful and not descriptive or suggestive of the array of consumer products 200, the first consumer product 210, and/or the second consumer product 230. Illustrative examples of such arbitrary or fanciful brand names, includes wizzo, crunchy frog, llama, stig, Captain melon head, Rimmer, and the like. In one alternative embodiment the lesser indicia 250 could be a brand name which is descriptive or suggestive of the array of consumer products 200 and not arbitrary or fanciful. Illustrative examples of such descriptive or suggestive brand names includes, Soothing Lavender, Calming Peach, Mango Surprise, Date and Fig, Chocolate Sprinkles Royale, Calm, Sooth, Relax, Enjoy, and the like and combinations thereof.

The first consumer product 210 and second consumer product 230 have in association with both of the at least two unifying thematic elements 260, and 270. In the example array illustrated in FIG. 3, the unifying thematic element 260 is the color of the stripe which are matching, that is, the colors are the same. In an alternative, but not illustrated example the unifying thematic element 260 could be a coordinating color or colors. In another alternative not illustrated example the unifying thematic element could be that the unifying thematic element 260 on the first consumer product 210, is a color and the second consumer product 230 is transparent/translucent at the portion of the unifying thematic element 260 and the product, such as a composition releasably contained in the second consumer product 230 matches and/or coordinates with the color of the first consumer product 210.

Additionally, in the example array illustrated in FIG. 3, the unifying thematic element 270 is the cap of first consumer product 210 and the second consumer product 230, which are a matching color. In an alternative, but not illustrated example the unifying thematic element 270 could be a coordinating color or colors.

The first consumer product 210 and second consumer product 230 also have in association both of the at least two discontinuous elements 280, and 290. In the example product array 200 illustrated in FIG. 3, the discontinuous element 280 is the shape of the packages, which are different. In an alternative, but not illustrated example the discontinuous element 280 could be footprint of the packages, or even the volume of the packages. Additionally, in the example array of consumer products 200 illustrated in FIG. 3, the discontinuous element 290 is cap of the first consumer product 210 and the second consumer product 230, which different in shape. In an alternative, but not illustrated example this discontinuous element 290 could be that the cap of the first consumer product 210 has to be removed in order to access the contents therein. Where as the cap of the second consumer product can be subjected to some operation other than removal such as, twisting, moving up, moving down or the like or combinations thereof, in order to access the contents therein.

Figure 4:
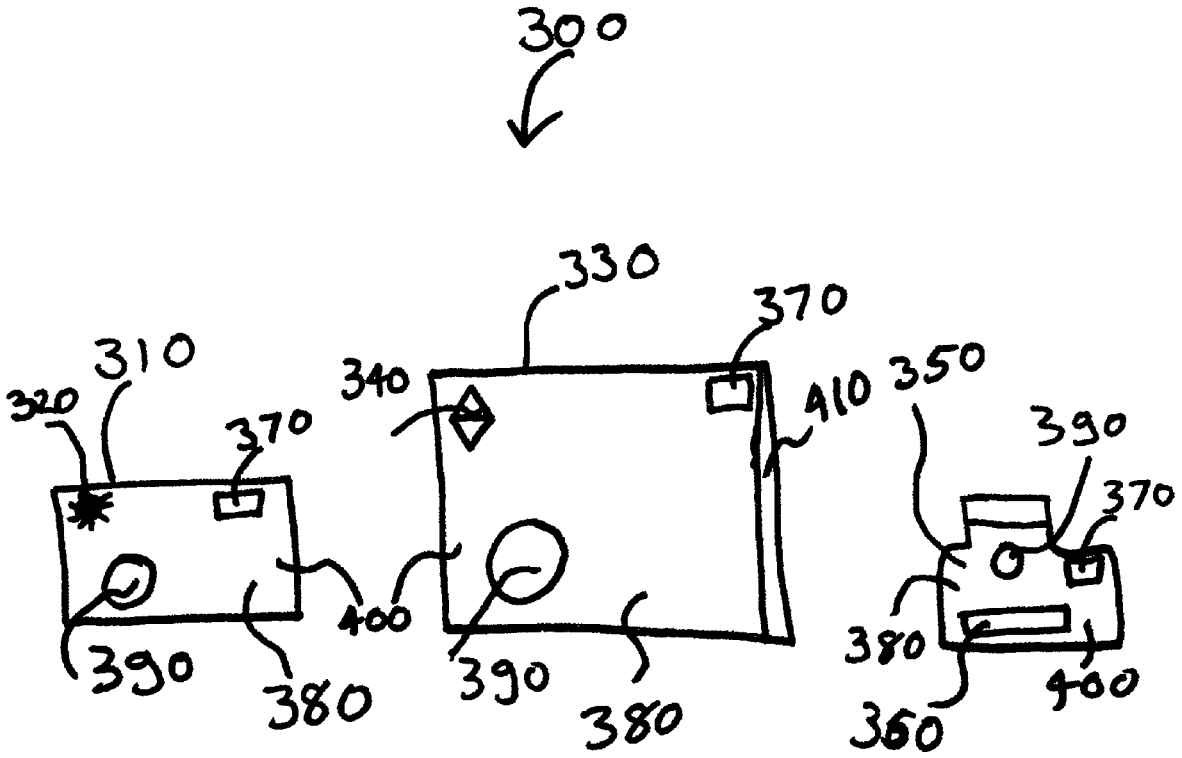
FIG. 4 is an illustrative example of yet still another array of consumer products in accordance with an embodiment of this invention.

FIG. 4, is an array of at three consumer products 300, comprising a first consumer product 310, having a first primary indicia in association therewith 320, a second consumer product 130 having a second primary indicia in association therewith 140 and a third consumer product 350, having a third primary indicia in association therewith 360. In one alternative illustrative embodiment first consumer product 310, is a package of tampons or similar interlabial feminine hygiene products, the second consumer product 330 are maxi pads, panty liners or similar feminine hygiene products and the third consumer product 350 are medicaments relating to the menstrual cycle, such as, analgesics designed to reduce period pain, vitamins, neutraceuticals and the like.

The lesser indicia is in association therewith 370 all of the first consumer product 310, the second consumer product 330 and the third consumer product 350. In this example the lesser indicia 370 is an icon which is not only identical but also located in approximately the same spatial location on each of the consumer products of the array 300. This icon could take many forms, such as a symbol of figure. In one alternative non illustrated example the lesser indicia 370 could be in the form of a logo constructed as a device from at least three groups of symbols, a first of the three groups representing one product category, a second of the three groups representing another product category, and a third of the three group representing corporate values. This device may optionally be in the form of alphanumeric symbols, such as, letters, numbers, symbols such as =, +, $, ¥, §, *, #, !, ?, @, and the like; shapes; forms; and combinations thereof.

The first consumer product 310, second consumer product 330 and third consumer product 350 have in association with both of the at least two unifying thematic elements 380, and 390. In the example consumer product array 300 illustrated in FIG. 4, the unifying thematic element 380 is the packages or container are matching colors, that is the colors are the same. In an alternative, but not illustrated example the unifying thematic element could be a coordinating color or colors.

Additionally, in the example consumer product array 300 illustrated in FIG. 4, the unifying thematic element 390 is a certification mark, such as a mark, symbol, logo and or design form an organization that would be related to the use the consumers goods of the array 300 would be put. An illustrative example of this would be, for example for an array of feminine hygiene products a certification mark from a medical organization, research group or society that would be associated with women's health or obstetrics and the like.

The first consumer product 310, second consumer product 330 and third consumer product 350 also have in association with both of the at least two discontinuous elements 400, and 410. In the example consumer product array 300 illustrated in FIG. 4, the discontinuous element 480 is the material of the packages, which are different. The material comprising the container of the first consumer product 310 is cardboard; the material comprising the container of the second 330 consumer product is a polymeric film, while the material comprising the container of the third consumer product 350 is a high density polyethylene resin. These three different materials all present a different visual appearance as well as feeing different to the touch.

Additionally, in the example consumer product array 300 illustrated in FIG. 4, the discontinuous element 410 is a window which is only present in the second consumer product 330. This window allows the consumer to readily ascertain how much product remains in the consumer product 330. No such window is present on either of the first consumer product 310 or the third consumer product 350.

Figure 5:
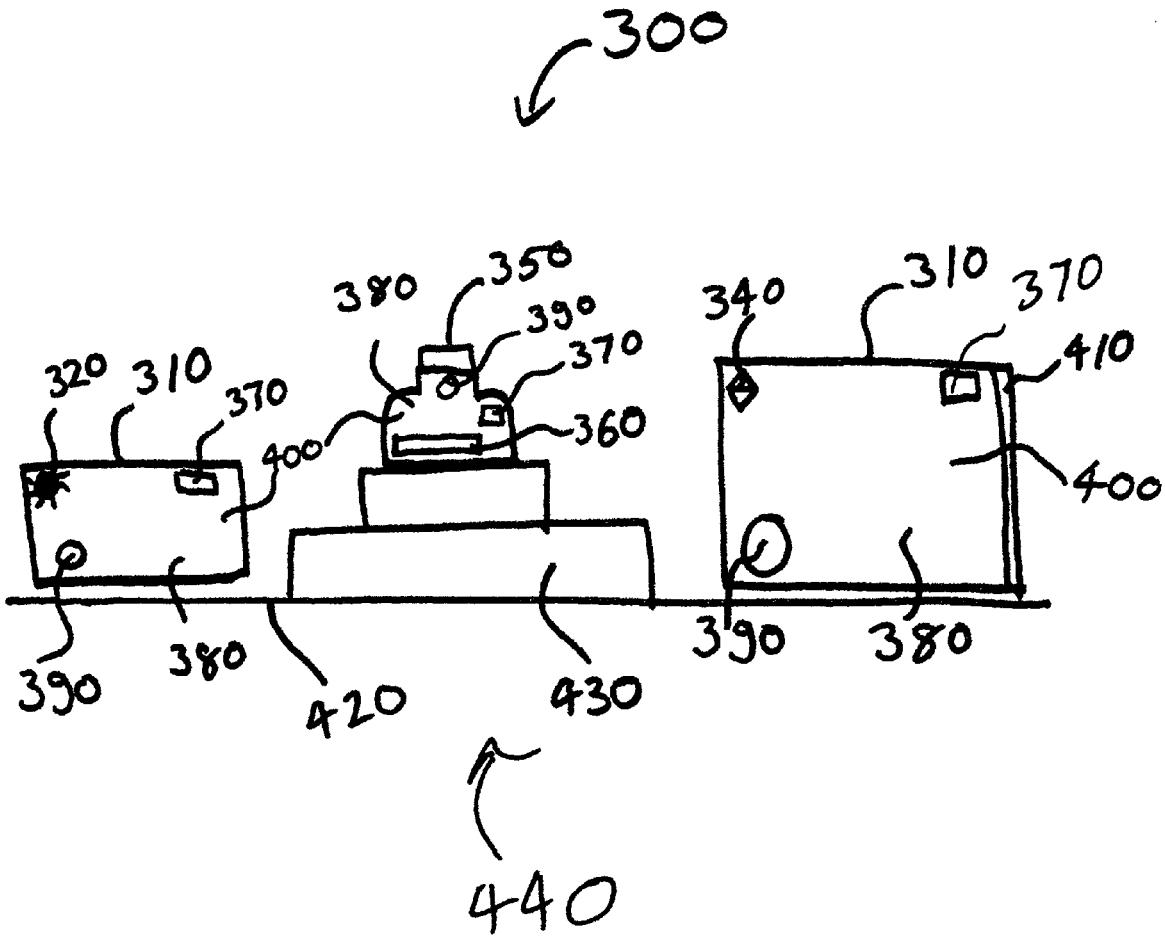
FIG. 5 is an illustrative example of a retail display in accordance with an embodiment of this invention comprising the illustrative array of consumer products according to FIG. 4.

FIG. 5, is an illustrative example of a retail display 440 of the array of consumer products 300, previously illustrated in FIG. 4. The array of consumer products is arranged on a shelf 420 in a store. The retail display 440 may be on a single shelf as illustrated and include an optional podium, 430. The podium 430 may be used to highlight or draw a consumer's attention to one or more members of the consumer product array 300, in this case the third consumer product 350. Alternatively, the podium may be used to arrange the array of consumer products 300 in such as fashion so that all of the consumer products 310, 330 and 350 appear to be the same height or that the lesser indicia 370 is at the same level. Additionally, but not illustrated in the figures, the optional podium 430 may include one or more of the lesser indicia 370, the unifying thematic elements 380 and 390 and/or the discontinuous elements 400 and 410.

Figure 6:
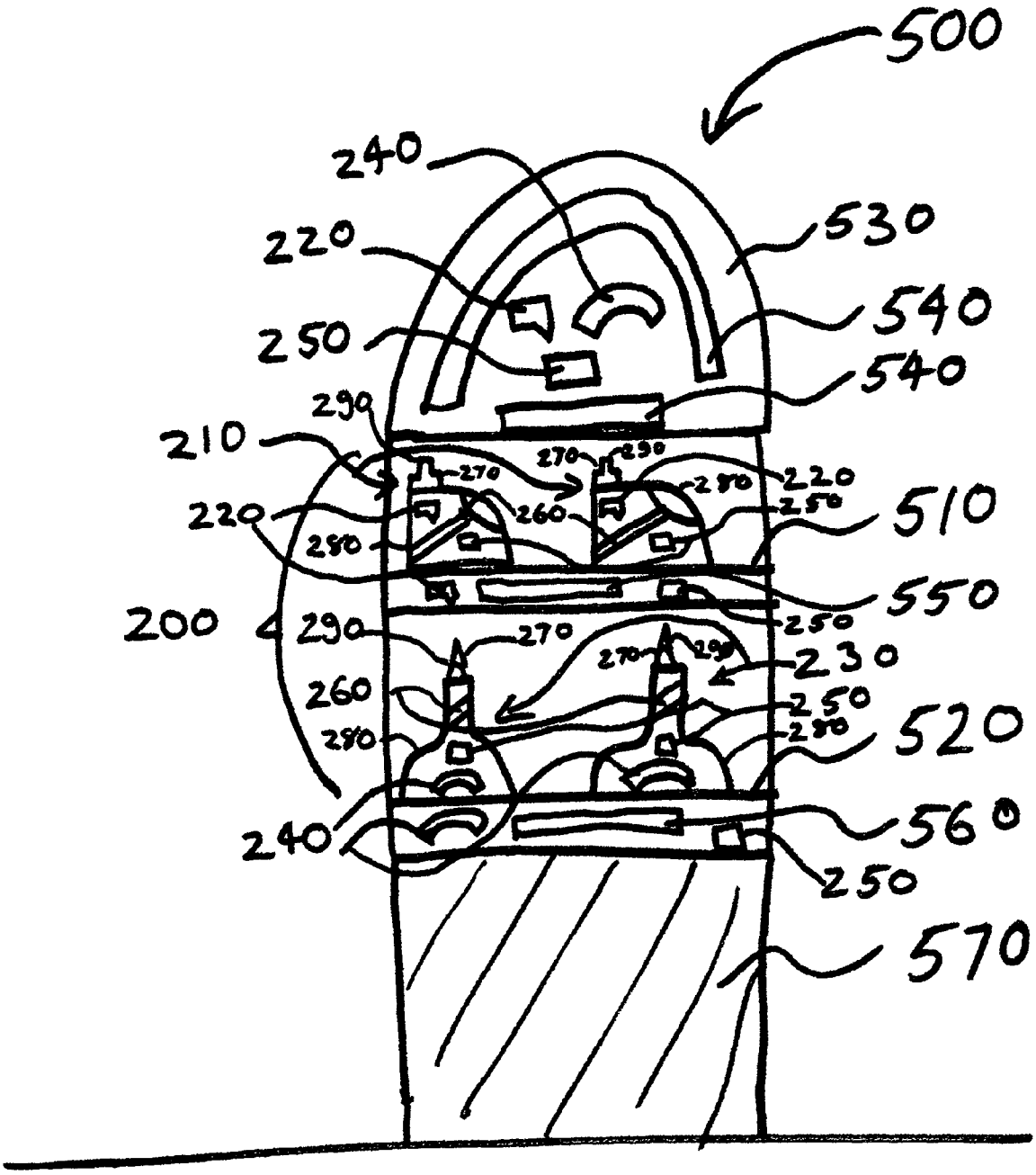
FIG. 6 is an illustrative example of another retail display in accordance with an embodiment of this invention comprising the illustrative array of consumer products according to FIG. 3.

FIG. 6 is another illustrative example of a retail display. FIG. 6 is an illustrative example of a free standing retail display 500 of the array of consumer products 300, previously illustrated in FIG. 3. The free standing retail display 500 could be placed at the end of an isle in a store or it could be placed at any other suitable location in a store. The free standing retail display 500 could be prepared as is, that is already containing the array of consumer products 200, by the same company that makes the array of consumer products 200, and readily assembled on site in the store. Alternatively, the free standing retail display 500 could be a modular arrangement that is sent to a retail location and can be configured in different arrangements to display different arrays of consumer products ate different times.

The free standing retail display 500 optionally comprises an upper shelf 510 on to which in this instance the two of the first consumer product 210 are placed and a lower shelf 520 on to which in this instance the two of the first consumer product 210 are placed, thereby forming the array of consumer products 200 on two different shelves. Alternatively, each of the upper shelf 510 and lower shelf 520 could comprise an individual array of consumer products 200. Another illustrative but not shown example would be that the upper shelf 510 has one array of consumer products, such as the array 200, and the lower shelf 520 has a different related or even unrelated array of consumer goods.

Each of the upper shelf 510 and lower shelf 520 may independently have in association therewith the first and second primary indicia 220 and 240 and the lesser indicia 250. In another exemplary embodiment, but not illustrated in the figures, each of the upper shelf 510 and lower shelf 520 may independently have in association therewith one or more of the at least two unifying thematic elements 260, and 270 and one or more of the least two discontinuous elements 280, and 290.

Additionally each of the upper shelf 510 and lower shelf 520 may have in association therewith a first tailored message 550 and a second tailored message 560. These messages may comprise branding, packaging, properties, sound, words, phrases, letters, characters, brand names, company names, company logos or symbols, descriptions, logos, icons, designs, designer names, symbols, motifs, insignias, figures, marks, signals, colors, textures, shapes, tokens, advertisements and combinations thereof. Alternatively, these first and second tailored messages 550 and 560 may comprise a way for the consumer to sample a property belonging to all the products of the array 200, such as a "scratch and sniff" panel to experience the scent of the consumer products of the array 200. Alternatively, each of these first and second tailored messages 550 and 560 may comprise a non-interactive electronic display of information, such as text messages, sound such as music and/or spoken works and/or audiovisual presentations, such as, illustrations on how the array of products 200 are to be use, television advertisements featuring the array of consumer products 200 and the like.

In another alternative illustrative example these first and second tailored messages 550 and 560 may comprise other interactive devices, such as, modified slide-rule type device (for example, a dial or wheel on the free standing retail display 500), interactive computer which will prompt the user to answer questions, keep track of the answers, and provide advice to the consumer or line the user to an interactive site on the World Wide Web, Charts, tables or other figures and combinations thereof.

Additionally the free standing retail display 500 may optionally comprises banner 530 having in association therewith information about the individual consumer products 210 and 230 and/or the array 200 as a whole. The banner may also optionally have in association therewith the first and second primary indicia 220 and 240 and the lesser indicia 250. In another illustrative but not shown example the banner 530 may comprise one or more of the at least two unifying thematic elements 260, and 270 and one or more of the least two discontinuous elements 280, and 290. This may take the form of having at least a portion of the free standing retail display 500 optionally being a matching and/or contrasting color, such as the banner 530 and/or the base 570.

EXAMPLES

Example 1

An array of Consumer Products for Use in the Kitchen

An array of two consumer products is prepared. The first consumer product is a dishwashing detergent having as its principle indicia the brand name COLGATE PALMOLIVE. The consumer identification therewith is gentle on your hands while a consumer uses the consumer product. The consumer benefit of this consumer product is that it is a mild product. The second consumer product is a scouring pad having as its principle indicia the brand name SCOTCH-BRITE. The consumer identification therewith is the quality, strength and durability of the scouring pads. The consumer benefit of this consumer product is the ease of use.

Both of these products have prominently displayed on each of their respective packaging the term POWER SCRUBBER, which is the lesser indicia. Both packages are the same orange color and have a smiling sun icon printed thereon. These two elements are the unifying thematic elements. Lastly, the packages are different in shape, the dish detergent being a cylinder of polymer, principally polyethylene, while the scouring pad is rectangular in shape and principally made of cardboard. These differences are the at least two discontinuous elements.

Example 2

An array of Feminine Hygiene Products

An array of three consumer products is prepared. The first consumer product is maxi pads having as its principle indicia the brand name STAYFREE. The consumer identification therewith is comfort while a consumer uses the consumer product. The consumer benefit of this consumer product is that it is inexpensive, i.e. value. The second consumer product is a tampon having as its principle indicia the brand name O.B. The consumer identification therewith is value. The consumer benefit of this consumer product is the ease of use. The third consumer product is a product for relieving the pain associated with menstruation having as its principle indicia the brand name PAMPRIN. The consumer identification therewith is comfort while a consumer uses the consumer product. The consumer benefit of this consumer product is the ease of use and reliability.

All of these products have prominently displayed on each of their respective packaging the term FEMMINE RELIEF!, which is the lesser indicia. Both packages are the same shape, namely rectangular, are all the same soothing blue color and have a picture of a serene, calm and relaxed woman in a yoga position printed thereon. These three elements are the unifying thematic elements. Lastly, the first consumer product has a patent marking statement different than that of the second consumer product, as well as a window in its package so a consumer can count how many maxi pads are left in the package with out having to open the package. The third consumer product has no patent marking statement. These are the discontinuous elements Example 3

Array of Laundry Products

An array of two Laundry products is prepared. The first laundry product is a liquid laundry detergent, having as its principle indicia the brand name WISK. The consumer identification therewith is an inexpensive product, i.e. value. The consumer benefit of this consumer product is cleaning. The second consumer product is a fabric softener having as its principle indicia the image of a bear, namely the SNUGGLE bear. The consumer identification therewith is the value of the product. The consumer benefit of this consumer product is value and softness.

Both of these products have prominently displayed on each of their respective packaging the term EASY COMFORTS, which is the lesser indicia. The WISK container is an opaque brick red color, whereas the fabric softener is predominately transparent and the fabric softening composition therein is the same or substantially similar brick red color as the WISK container. The lids of both containers are the same blue grey color, and the products have the same scent which is raspberry and lemon. The name of the scent also appears on both packages along with identical images of two raspberries and a lemon. These elements are the unifying thematic elements. Lastly, the packages are different in size, the WISK container being short and squat and having a handle, while the fabric softener is tall and thin and has no handle. Additionally the fabric softener has a narrative scent descriptor in association with the product. The narrative scent descriptor is "These scents have been selected to provide a warm and fruity washing experience." This narrative scent descriptor is printed on a card that is removably attached to the lid of the fabric softener container. These differences are the discontinuous elements.

Example 4

Array of Laundry Products

An array of Laundry products according to Example 3 above, but also including a third consumer product, namely dryer sheets having as its principle indicia the image of a bear, namely the SNUGGLE bear. The consumer identification therewith is the value of the product. The consumer benefit of this consumer product is value and scent.

All of these products have prominently displayed on each of their respective packaging the term EASY COMFORTS, which is the lesser indicia. The WISK container and the third product are an opaque brick red color, whereas the fabric softener is predominantly transparent and the fabric softening composition therein is the same or substantially similar brick red color as the WISK container or the third product. The lids of both the first and second product containers are the same blue grey color, and all products have the same scent which is raspberry and lemon. The name of the scent also appears on all packages along with identical images of two raspberries and a lemon. These elements are the unifying thematic elements. Lastly, the packages are different in size, the WISK container being short, squat, opaque and having a handle, while the fabric softener is tall, thin, predominanently transparent and has no handle, and the third product is a rectangular prism made of cardboard. Additionally both the fabric softener and the third product have a narrative scent descriptor in association with the product. The narrative scent descriptor is "These scents have been selected to provide a warn and fruity washing experience." This narrative scent descriptor is printed on a card that is removably attached to the lid of the fabric softener container, whereas it is printed directly on to on side of the third product. These differences are the discontinuous elements.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

The compositions of the present invention can include, consist essentially of, or consist of, the components of the present invention as well as other ingredients described herein. As used herein, "consisting essentially of" means that the composition or component may include additional ingredients, but only if the additional ingredients do not materially alter the basic and novel characteristics of the claimed compositions or methods.

Except as otherwise noted, the articles "a," "an," and "the" mean "one or more."

All percentages stated herein are by weight unless otherwise specified. It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein. All temperatures are in degrees Celsius (° C.) unless otherwise specified.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An array of laundry products comprising:

(a) a first laundry product including a first package having associated therewith a first principle indicia selected from branding, words, phrases, letters, characters, brand names, company names, company logos or symbols, logos, icons, designs, designer names, symbols, insignias, shapes and combinations thereof, wherein said first principle indicia has a first consumer identification therewith and a first consumer benefit; and (b) a second laundry product having a second package that (i) is a different size and/or shape than the first package and (ii) stands apart from the first package, the second laundry product having associated therewith a second principle indicia selected from branding, words, phrases, letters, characters, brand names, company names, company logos or symbols, logos, icons, designs, designer names, symbols, insignias, shapes and combinations thereof, wherein said second principle indicia is different than said first principle indicia and has a second consumer identification therewith which is different than said first consumer identification and a second consumer benefit which is different than said first benefit;

wherein both of said first laundry product and said second laundry product have in association therewith:

a lesser indicia;

at least two unifying thematic elements; and at least two discontinuous elements;

and wherein said first laundry product is a laundry detergent; and said second laundry product is a softener;

wherein the at least two unifying thematic elements comprise the first package and the second package including lids of substantially the same color and the first laundry product and the second laundry product having substantially the same scent.

2. An array of laundry products according to claim 1 further comprising:

a third laundry product having a third package that stands apart from the first and second packages and having associated therewith a third principle indicia selected from branding, words, phrases, letters, characters, brand names, company names, company logos or symbols, logos, icons, designs, designer names, symbols, insignias, shapes and combinations thereof, wherein said third principle indicia has a third consumer identification therewith and a third consumer benefit; and wherein all of said first laundry product, second laundry product and said third laundry product have in association therewith:

a lesser indicia;

at least two unifying thematic elements; and at least two discontinuous elements; and wherein said third laundry product is selected from laundry detergent, fabric softeners, dryer sheets, light duty detergents, laundry pretreaters, dye magnets, stain removing devices, bleaching compositions, water softeners, pretreater compositions, pre-treatment devices, dye trapping sheets, and fabric refreshing compositions.

3. An array of laundry products according to claim 1 wherein said first principle indicia is selected from branding, words, phrases, characters, brand names, company names, company logos or symbols, descriptions, logos, icons, designs, designer names, insignias, and combinations thereof.

4. An array of laundry products according to claim 1 wherein said second principle indicia is selected from branding, words, phrases, characters, brand names, company names, company logos or symbols, descriptions, logos, icons, designs, designer names, insignias, and combinations thereof.

5. An array of laundry products according to claim 1 wherein said first consumer identification is selected from images; scent; sound; character; story; scenario; theme; and combinations thereof.

6. An array of laundry products according to claim 1 wherein said second consumer identification is selected from images; scent; sound; character; story; scenario; theme; and combinations thereof.

7. An array of laundry products according to claim 1 wherein said first consumer benefit is selected from cleaning, softness, scent, ease of use, reliability, value, water conservation, energy conservation, protecting fabric fibers from damage, increasing the lifetime of fabrics, providing color care, preserving fabric integrity, preserving fabric shape, anti-shrinkage, maintaining the original or natural texture or feel of the garment and combinations thereof.

8. An array of laundry products according to claim 1 wherein said second consumer benefit is selected from cleaning, softness, scent, ease of use, reliability, value, and combinations thereof.

9. An array of laundry products according to claim 1 wherein said lesser indicia is selected from scent, branding, packaging, properties, sound, words, phrases, letters, characters, brand names, company names, company logos or symbols, descriptions, logos, icons, designs, designer names, symbols, motifs, insignias, figures, marks, signals, colors, textures, shapes, tokens, advertisements and combinations thereof.

10. An array of laundry products according to claim 1 wherein said unifying thematic elements are selected from scent, branding, packaging, properties, sound, words, phrases, letters, characters, brand names, company names, company logos or symbols, descriptions, logos, icons, designs, designer names, symbols, motifs, insignias, figures, marks, signals, colors, textures, shapes, tokens, advertisements, and combinations thereof.

11. An array of laundry products according to claim 1 wherein said discontinuous elements are selected from scent, branding, packaging, properties, sound, words, phrases, letters, characters, brand names, company names, company logos or symbols, descriptions, logos, icons, designs, designer names, symbols, motifs, insignias, figures, marks, signals, colors, textures, patent marking statement, shapes, tokens, advertisements, and combinations thereof.

12. An array of laundry products according to claim 1 wherein said lesser indicia is suggestive and/or allutive of the scent of said first consumer product and said second consumer product.

13. A method for displaying an array of laundry products for retail sale comprising the steps of (i) placing on a display in a store a first laundry product comprising an opaque container and a composition contained therein, wherein said opaque container comprises a first color, and first laundry product having associated therewith a first principle indicia selected from branding, words, phrases, letters, characters, brand names, company names, company logos or symbols, logos, icons, designs, designer names, symbols, insignias, shapes and combinations thereof; (ii) placing on said display a second laundry product comprising a translucent/transparent container and a colored composition contained therein that is visible from outside the translucent/transparent container, wherein said colored composition substantially matches said first color, said second laundry product having associated therewith a second principle indicia selected from branding, words, phrases, letters, characters, brand names, company names, company logos or symbols, logos, icons, designs, designer names, symbols, insignias, shapes and combinations thereof, wherein both of said first laundry product and said second laundry product have a secondary indicia in association therewith, and said second laundry product is adjacent said first laundry product.

14. An array of laundry articles comprising:

(a) laundry cleaning product comprising:

(i) a laundry cleaning composition comprising a perfume;

(ii) an opaque container releasably containing said laundry cleaning composition;

(iii) at least one first label attached to said opaque container; and (iv) a first natural scent identifier located on said first label;

(b) a fabric care product comprising:

(i) a fabric care composition containing said perfume;

(ii) a container releasably containing said fabric care composition, wherein at least 20% of the total surface area of the container is clear or translucent thereby providing a clear or translucent portion of the container through which the fabric care composition can be viewed from outside the container, a color of the fabric care composition substantially matching a color of the opaque container;

(iii) at least one second label attached to said container, the second label being arranged and configured to allow viewing of the fabric care composition through the clear or translucent portion from outside the container; and (iv) a second scent identifier located on said second label;

wherein said first natural scent identifier is the same as said second natural scent identifier.

15. The array of articles according to claim 14, wherein said first natural scent identifier and said second natural scent identifiers are chosen from the following terms: vanilla, lavender, lilac, honeysuckle, rose, gardenia, jasmine, freesia, green apple, magnolia, lily of the valley, orchid, melon, violet, lily, pear, morning glory, chamomile, cucumber, almond, mandarin, mint, lemongrass, lime, snowflower, grapefruit, juniper, peony, sandalwood, tea tree, moonflower, lotus flower, iris, ylang ylang, cedarwood, ginger, green tea, patchouli, geranium, rosemary, tuberose, chrysanthemum, verbena, neroli, bergamot, thyme, marigold, bamboo, vetyver, orange, magnolia.

16. An array of laundry articles according to claim 14 further comprising:

(c) second fabric enhancer product comprising:

(i) a second fabric care composition comprising a perfume;

(ii) a second opaque container releasably containing said second fabric enhancer;

(iii) a third natural scent identifier located on second opaque container; and wherein said third natural scent identifier is the same as said second natural scent identifier and said first natural scent identifier.

17. An array of laundry articles comprising:

(a) a laundry cleaning product comprising:

(i) a laundry cleaning composition comprising a lavender scent perfume;

(ii) an opaque container releasably containing said laundry cleaning composition;

(iii) at least one first label attached to said opaque container; and (iv) a first natural scent identifier located on said first label;

(b) a fabric care product comprising:

(i) a fabric care composition comprising a lavender scent perfume;

(ii) a container releasably containing said fabric care composition, wherein the container includes a clear or translucent portion through which the fabric care composition can be viewed from outside the container, a color of the fabric care composition substantially matching a color of the opaque container;

(iii) at least one second label attached to said container, the second label being arranged and configured to allow viewing of the fabric care composition through the clear or translucent portion from outside the container; and (iv) a second scent identifier located on said second label;

wherein said first natural scent identifier is the same as said second natural scent identifier.

18. An array of laundry products according to claim 1 wherein one of the at least two discontinuous elements is a difference in shape between the first and second packages and another of the at least two discontinuous elements is presence of a narrative descriptor that is printed on a card attached to only one of the first and second packages.

* * * * *